US011058188B2

(12) United States Patent
Dhadwal

(10) Patent No.: US 11,058,188 B2
(45) Date of Patent: Jul. 13, 2021

(54) SINGLE-FINGER ZIPPERS

(71) Applicant: Raj Dhadwal, Portland, OR (US)

(72) Inventor: Raj Dhadwal, Portland, OR (US)

( * ) Notice: Subject to any disclaimer, the term of this patent is extended or adjusted under 35 U.S.C. 154(b) by 36 days.

(21) Appl. No.: 16/507,298

(22) Filed: Jul. 10, 2019

(65) Prior Publication Data

US 2020/0022467 A1 Jan. 23, 2020

Related U.S. Application Data

(60) Provisional application No. 62/702,024, filed on Jul. 23, 2018.

(51) Int. Cl.
*A44B 19/26* (2006.01)
*A44B 19/14* (2006.01)

(52) U.S. Cl.
CPC ..... *A44B 19/262* (2013.01); *A44B 19/14* (2013.01)

(58) Field of Classification Search
CPC ..... A44B 19/14; A44B 19/26; A44B 19/262
See application file for complete search history.

(56) References Cited

U.S. PATENT DOCUMENTS 2,854,722 A * 10/1958 Duche ..... A47G 25/902 24/514
5,771,546 A * 6/1998 Minato ..... A44B 19/262 24/429
9,545,134 B1 * 1/2017 Tan ..... A44B 19/24
2004/0020017 A1 * 2/2004 Nedbal ..... A44B 19/262 24/429
2004/0148745 A1 * 8/2004 Moeller ..... A44B 19/262 24/429
2014/0041162 A1 * 2/2014 Keyaki ..... A44B 19/26 24/403
2016/0324273 A1 * 11/2016 Hahizume ..... A44B 19/26
2019/0059524 A1 * 2/2019 Minato ..... A44B 19/10

* cited by examiner

*Primary Examiner* — Robert Sandy
*Assistant Examiner* — David M Upchurch

(57) ABSTRACT

A fastening system, apparatus, and/or device for interlocking a first zipper tooth and a second zipper tooth. The fastening system, apparatus, and/or device may include a slider configured to vertically interconnect a first zipper tooth with a second zipper tooth, the slider comprising a bottom zipper receptacle including a first channel at a bottom portion of the slider and extending from a back of the slider to a front of the slider, a top zipper receptacle including a second channel at a top portion of the slider and extending from a back of the slider to the front of the slider, and a finger holder extending along a top surface of the slider where the finger holder has a concave shape that is configured to receive a finger of a user.

20 Claims, 7 Drawing Sheets

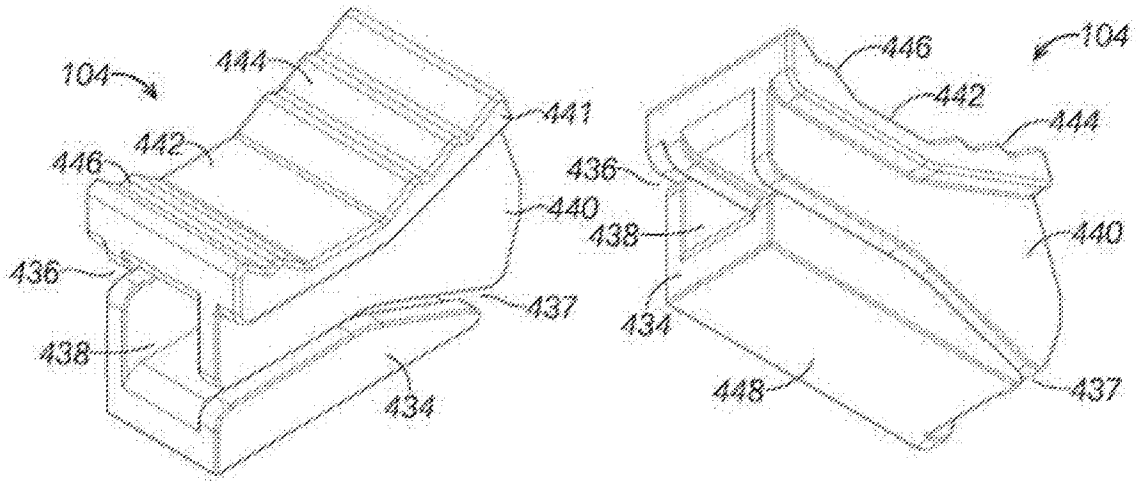
FIG. 4A
FIG. 4B
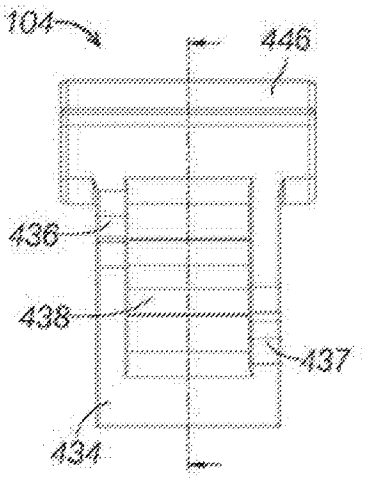
FIG. 4C
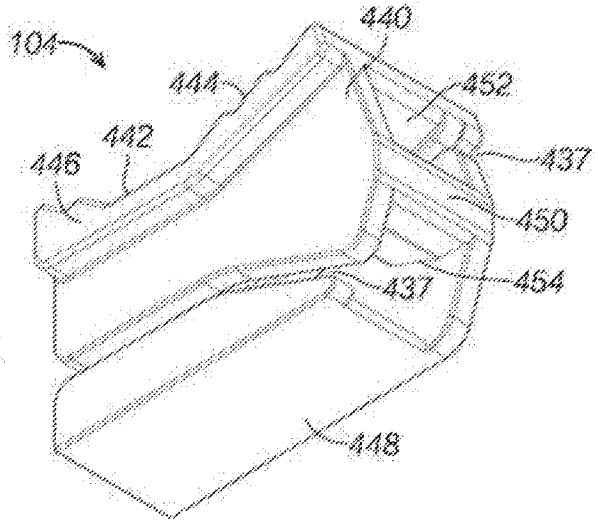
FIG. 4E
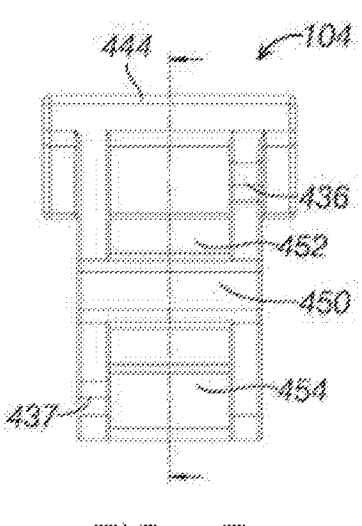
FIG. 4F
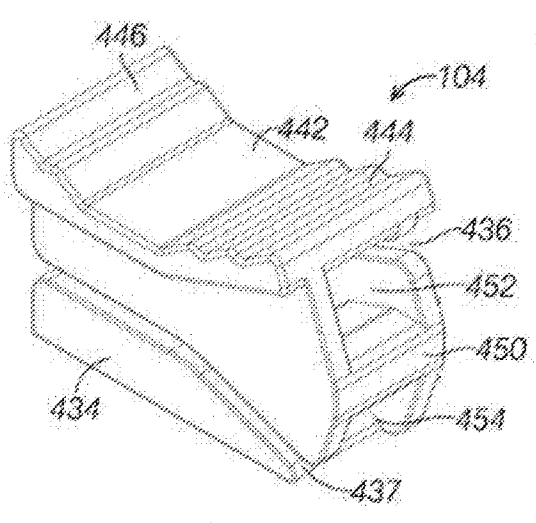
FIG. 4D

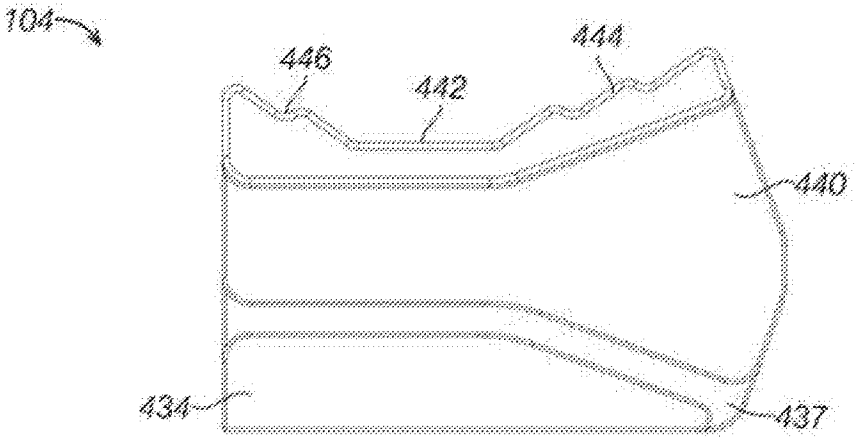
FIG. 4G
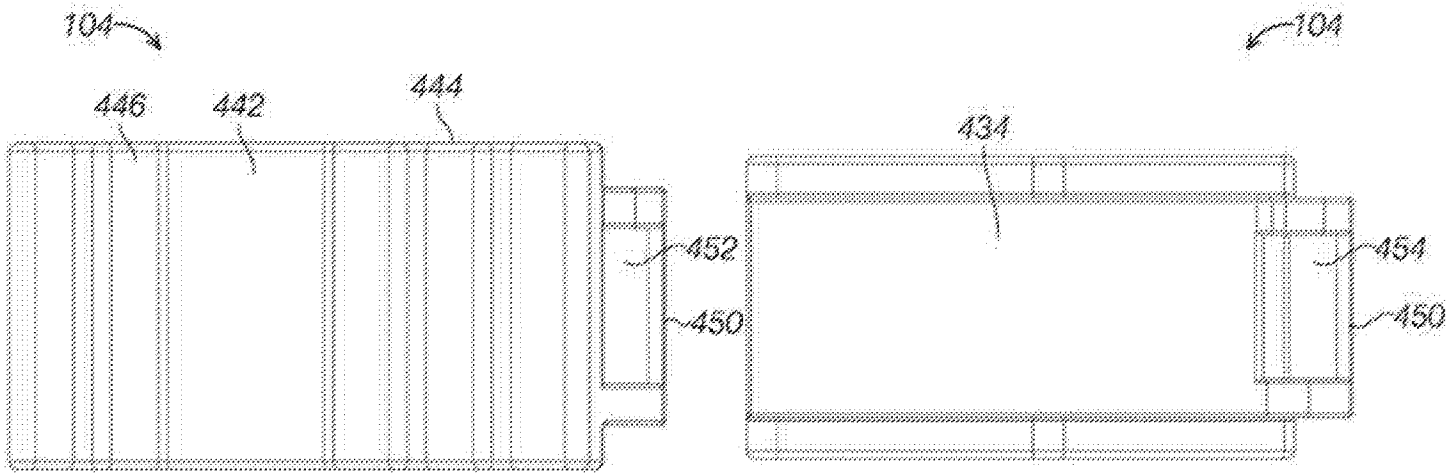
FIG. 4H
FIG. 4I

SINGLE-FINGER ZIPPERS

CROSS-REFERENCE TO RELATED APPLICATION

This application claims the benefit of U.S. Provisional Application No. 62/702,024, filed on Jul. 23, 2018, which are hereby incorporated by reference for all purposes.

BACKGROUND

Zippers are used to merge two materials or article halves to one another through subsets of teeth that are secured with the teeth facing away from the edge surface of the fabric. For example, a zipper may be used to merge two halves of a garment, a bag, luggage, a pocket, sporting goods, camping gear (e.g. tents and sleeping bags), and so forth.

BRIEF DESCRIPTION OF THE DRAWINGS

The present description will be understood more fully from the detailed description given below and from the accompanying drawings of various embodiments of the present embodiment, which is not to be taken to limit the present embodiment to the specific embodiments but are for explanation and understanding.

FIG. 4A illustrates a top rear perspective view of the slider (if the zipper in FIG. 1A, according to an embodiment.

FIG. 4B illustrates a bottom rear perspective view of the slider of the zipper in FIG. 1A, according to an embodiment.

FIG. 4C illustrates a rear view of the slider of the zipper in FIG. 1A, according to an embodiment.

FIG. 4D illustrates a top front perspective view of the slider of the zipper in FIG. 1A, according to an embodiment.

FIG. 4E illustrates a bottom rear perspective view of the slider of the zipper in FIG. 1A, according to an embodiment.

FIG. 4F illustrates a rear view of the slider of the zipper in FIG. 1A, according to an embodiment.

FIG. 4G illustrates a side cross-sectional view of the slider of the zipper in FIG. 1A, according to an embodiment.

FIG. 4H illustrates a top view of the slider of the zipper in FIG. 1A, according to an embodiment;

FIG. 4I illustrates a bottom view of the slider of the zipper in FIG. 1A, according to an embodiment.

DETAILED DESCRIPTION

Figure 1A:
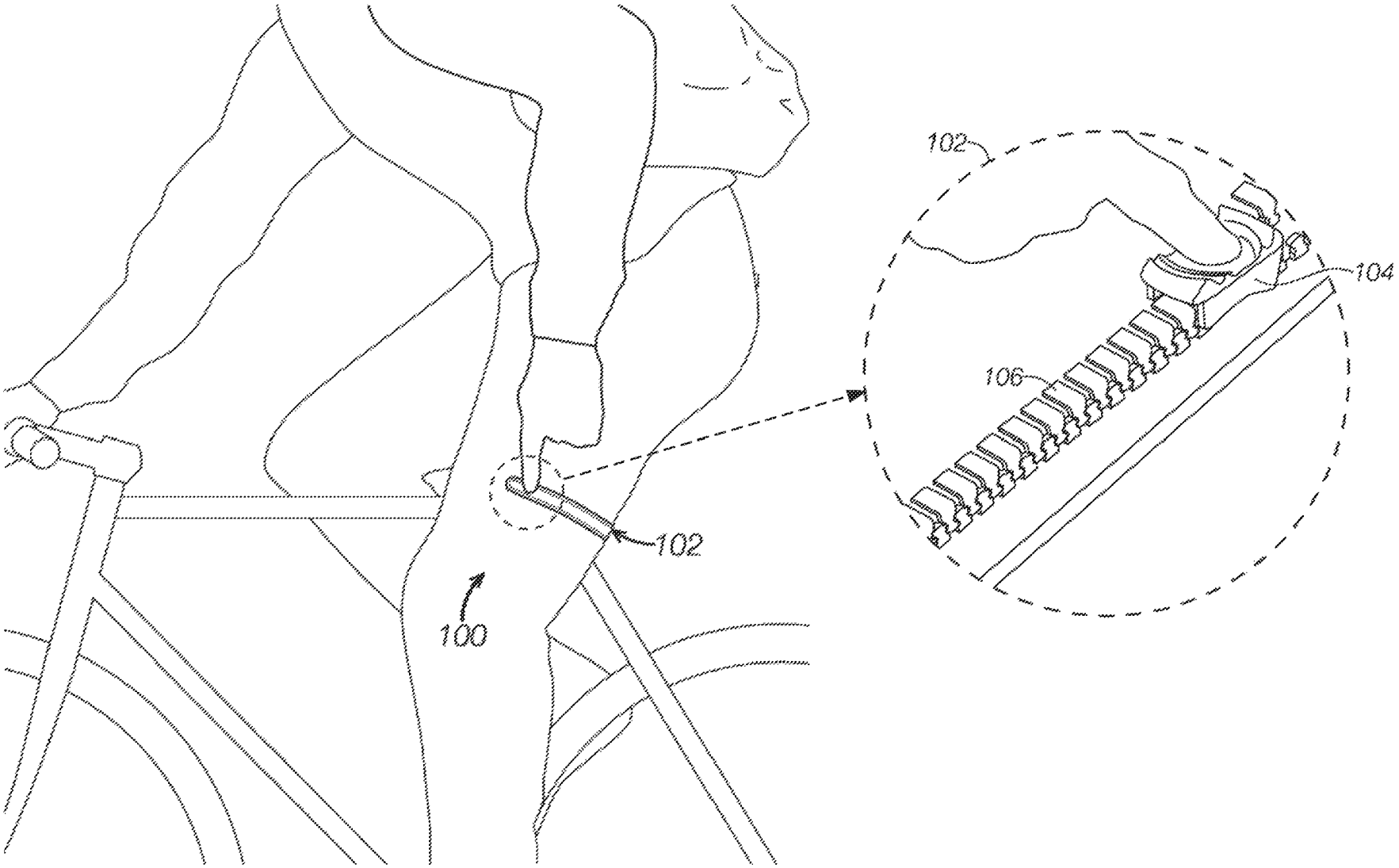
FIG. 1A illustrates an article with a single-finger zipper, according to an embodiment.

The disclosed single-finger zippers will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, a variety of single-finger zipper examples are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same as or (similar to the specific portrayal of a related feature in any given figure or example.

A zipper is a device used to bind or connect the edges of an opening of fabric or other flexible material. For example, the zipper may be used to connect edges of a garment, a bag, a clothing article (e.g., jackets and jeans), a piece of luggage, sporting goods, camping gear (e.g. tents and sleeping bags), and so forth. Conventional zippers include a slider that locks subsets of teeth in parallel. Each tooth in the subset of teeth faces away from the edge of a halve of the material. A conventional zipper is operated by a user using one hand to hold the edges of the halve of the material together and a second hand to pull the slider one direction to connect the teeth or another direction to disconnect the teeth.

The user operates the conventional zipper using two hands due to an outward-oriented shear force of the halves of the material when the material is pulled taut. For example, the teeth of a conventional zipper extend outwardly from the edges of the halves of the material so that the teeth face toward each other and allow the edges of the material halves to be fastened together along the edges of the material halves. The conventional zipper requiring two hands to operate the zipper may make it difficult for a user to operate the zipper in a variety of circumstances and environments. In one example, when a user is hunting, climbing, engaged in sports, carrying an object, or otherwise has one of his/her hands engaged and unavailable, the user may not be able to operate the conventional zipper. In another example, when the hands of a user lack dexterity, the user may not have the ability to operate the conventional zipper with two hands.

Implementations of the disclosure address the above-mentioned deficiencies and other deficiencies by providing a fastening system, device, and/or apparatus to interlock or connect to edges of a material together with a single finger or hand. The fastening system, device, and/or apparatus may include a zipper with a slider configured to vertically interlock teeth of the zipper. An advantage of the single-finger zipper may be to enable a user to move the slider of a zipper with a single finger by applying pressure to a top surface of the slider and sliding the slider in a first direction to disconnect the teeth of the zipper and the halves of the material and in a second direction to connect the teeth and the halves of the material.

FIG. 1A illustrates an article 100 with a single-finger zipper 102, according to an embodiment. In one embodiment, the article 100 may be an article of clothing, such as pants, a jacket, a shirt, and so forth. In another embodiment the article 100 may be a garment, a bag, a piece of luggage, sporting goods, camping gear (e.g. tents and sleeping bags), clothing, textile, fabric, and so forth. The type of article 100 is not intended to be limiting. The article 100 may be any type of article with a zipper integrated into it. In another embodiment, the single-finger zipper 102 may be referred to as a zip, a fly, a zip fastener, a clasp locker, and so forth. As further discussed below, the single-finger zipper 102 may be operated by a finger or hand of a user. For example, the article 100 may be the pants of the user and the single-finger zipper 102 may be integrated into a pocket of the pants so that the user may open and close the pocket as desired with a single finger or hand. The user may operate the single-finger zipper 102 by pressing a finger of his/her hand and sliding a slider 104 of the zipper in one direction to disconnect the teeth 106 of the single-finger zipper 102 and open the pocket and slide the slider 104 in the opposite direction to connect the teeth 106 and close the pocket.

Figure 1B:
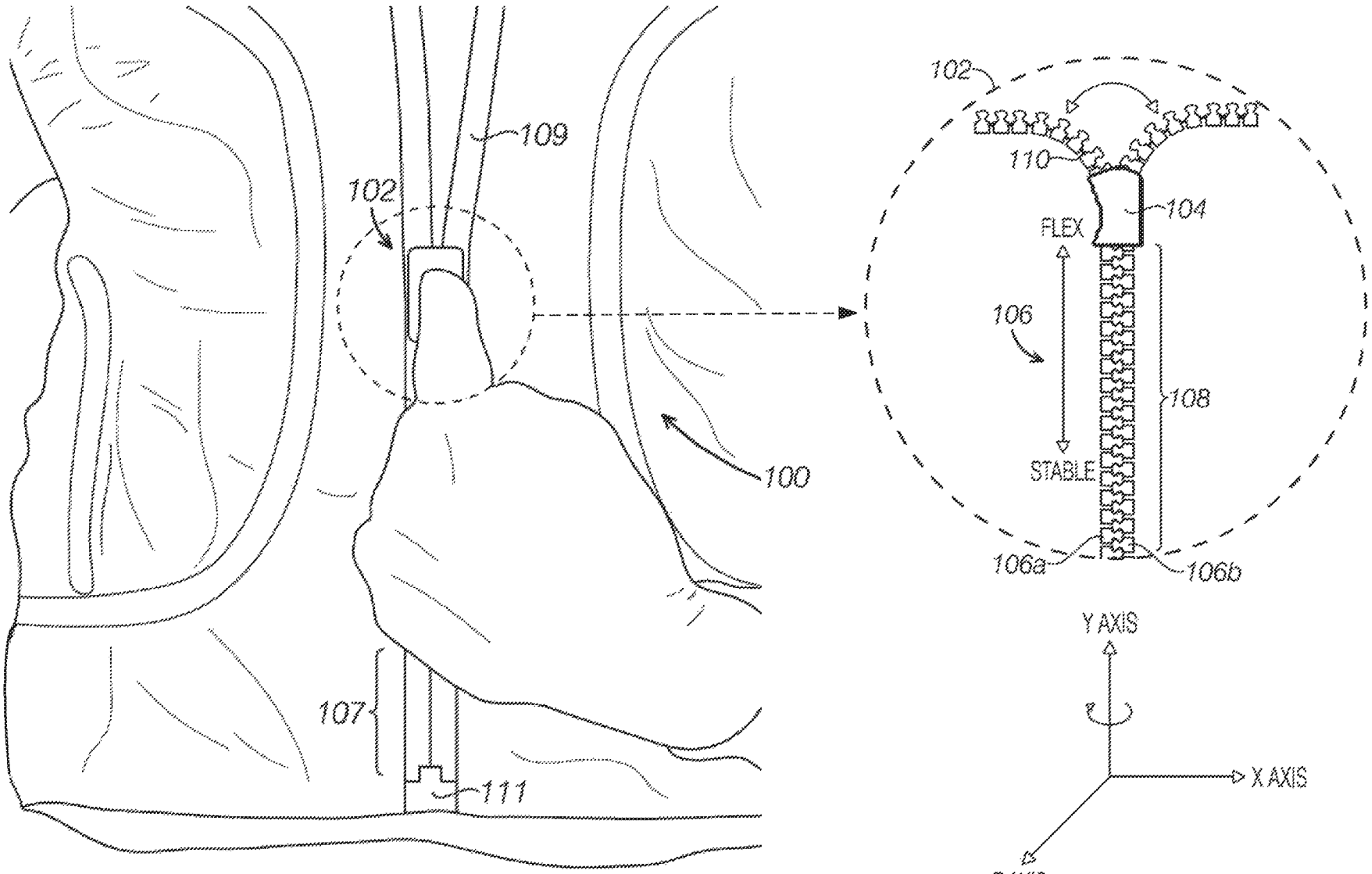
FIG. 1B illustrates the article with the single-finger zipper, according to an embodiment.

FIG. 1B illustrates the article 100 with the single-finger zipper 102, according to an embodiment. Some of the features in FIG. 1B are the same or similar to some of the features in FIG. 1A as noted by same reference numbers, unless expressly described otherwise. The single-finger zipper 102 may include a slider 104, teeth 106, a chain 107, a tab, tape 109, tape ends, a stop or a bridge stop 111, a pin, a box, and/or a sealer.

The chain 107 may be a continuous piece that is formed when teeth 106 connected to both halves of the single-finger zipper 102 are interconnected. The teeth 106 may be individual elements that make up the chain 107. The slider 104 may be a device that moves up and down the chain 107 to open or close the single-finger zipper 102. The tab may be integrated into the slider 104 and a user may hold and/or apply pressure to move the slider 104 in different directions, such as left and right or up and down. The tape 109 may be a fabric part of the single-finger zipper 102. The tape ends may be the fabric part of the single-finger zipper 102 that extend beyond the teeth at the top and/or bottom of the chain. The stop r lay be an apparatus affixed to the top end of a single-finger zipper 102 to prevent the slider from coming off the chain. The bottom stop or the bridge stop may be an apparatus device affixed to the bottom end of the single-finger zipper 102 to prevent further movement of each half of the single-finger zipper 102 from separating. The pin may be an apparatus used on a separating zipper type (such as a zipper on a coat or jacket), to allow the joining of the two single-finger zipper 102 halves. The box may be an apparatus used on the separating zipper type to correctly align the pin and begin the joining of the single-finger zipper 102 halves. The sealer may be a material fused to each halve of the zipper tape to connect the teeth to the halves of the material and reinforce the single-finger zipper 102.

The slider 104 may be configured to vertically interlock the teeth 106 of the single-finger zipper 102. In one example, a first subset of teeth 106*a* may be connected to a first portion of the article 100 and a second subset of teeth 106*b* may be connected to a second portion of the article 100. The first subset of teeth 106*a* may be configured to point downward and the second subset of teeth 106*b* may be configured to point upward, relative to each other, such that the first subset of teeth 106*a* and the second subset of teeth 106*b* are oriented at 90 degree angles relative to the edges of the halves of the article 100 such that the first subset of teeth 106*a* and the second subset of teeth 106*b* may vertically interconnect along the z-axis. The vertical interconnection of the first subset of teeth 106*a* and the second subset of teeth 106*b* may reduce or eliminate strain shear stresses and tensions of the halves of the article 100 along the x-axis and y-axis and allow a first halve of the article 100 to overlay a complementing a second halve of the article 100.

When the first subset of teeth vertically interlocks with the second subset of teeth, the teeth of the zipper may interlock such that at least a portion of the halves of the article 100 superpose on top of each other or overlap each other. In one example, the slider 104 may be configured to only contest the linear stresses and resistances native to the subset of teeth 106*a* and 106*b* and not the outward shearing forces from the conventional zipper configurations.

Figure 2A:
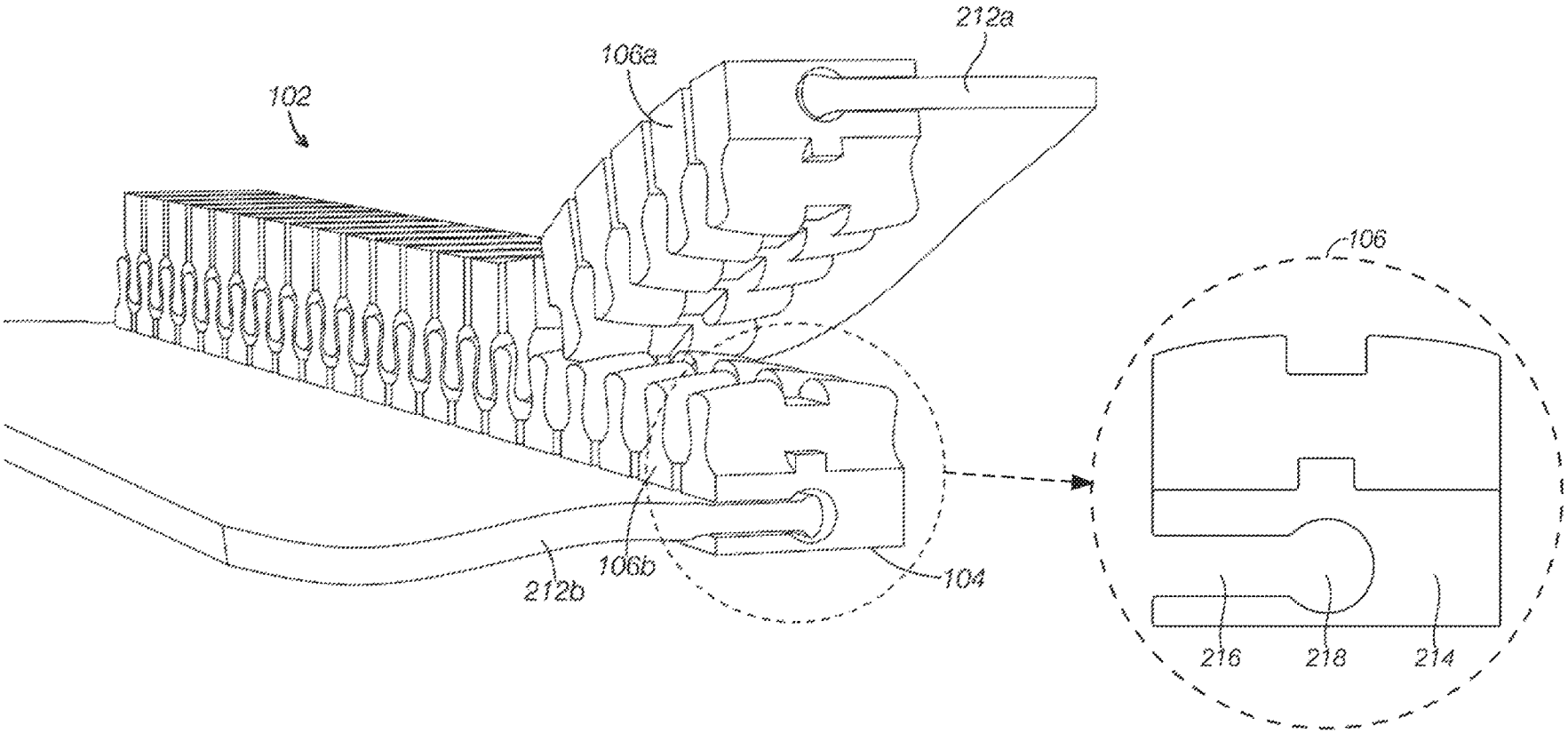
FIG. 2A illustrates the single-finger zipper with a set of interconnected teeth of a single-finger zipper and a slider, according to an embodiment.

FIG. 2A illustrates the single-finger zipper 102 with a set of interconnected teeth of a single-finger zipper 102 and a slider, according to an embodiment. Some of the features in FIG. 2A are the same or similar to some of the features in FIGS. 1A-1B as noted by same reference numbers, unless expressly described otherwise.

In one example, the teeth of the single-finger zipper 102 may include a first subset of teeth 106*a* and a second subset of teeth 106*b*. A tooth 10*b* of the first subset of teeth 106*a* and/or the second subset of teeth 106*b* may include a lower body 214 with a channel 216 extending along a horizontal plane partially into the lower body 214. The tooth 106 may include a cavity 218 at an end of the channel 216 location along the horizontal plane at a middle portion of the tooth 206.

In one embodiment, a tooth 106 of the first subset of teeth 106*a* may be connected to a top portion of the article 212*a* by an end of the top portion of the article 212*a* being inserted through the channel 216 into the cavity 218. In one example, the end of the top portion of the article 212*a* may be bunched up or compacted into the cavity 218 such that the tooth 106 may be secured to the end of the top portion of the article 212*a*. In another example, when the and of the top portion of the article 212*a* has been inserted into the cavity 218, the channel 216 may be clamped or compressed onto the end of the top portion of the article 212*a*. In another embodiment, a tooth 106 of the second subset of teeth 106*b* may be connected to a bottom portion of the article 212*b* by an end of the bottom portion of the article 212*b* being inserted through the channel 216 into the cavity 218. In one example, the end of the bottom portion of the article 212*b* may be punched up or compacted into the cavity 218 such that the tooth 106 may be seethed to the end of the bottom portion of the article 212*b*. In another example, when the end of the bottom portion of the article 212*b* has been inserted into the cavity 218, the channel 216 may be clamped or compressed onto the end of the bottom portion of the article 212*b*. The top portion of the article 212*a* and/or the bottom portion of the article 212*b* may correspond to the edges of a pocket, 'the fly' of pants, a closure, and so forth.

In another embodiment lower body 214 may include a basal structure for the tooth 106. The basal structure may aid in securing the tooth or the single-finger zipper 102 to the article 212*a* or 212*b*. In one embodiment the lower body 214 may be a single body formed through plastic injection molding directly to the material, such as a fabric article or a textile article. In another embodiment, the lower body 214 may include two separate jaws that may be punched together or secured together through snap fits where a fastener retains the platform to the material. The fastener may be epoxy, a hook, a snap, and so forth. In another embodiment, the lower body 214 may include a longitudinal dimension equivalent to the tooth. In another embodiment, the fastener may be a grip with the channel 216 and the cavity 218 that allows the article 212*a* or 212*b* to be passed through the channel 216 and the cavity 218 that is centered on one of the distal surfaces of the lower body 214 and formed of a rectilinear profile. For example, the channel 216 and the cavity 218 provide a top jaw and a bottom jaw of the lower body 214 where an opposing distal end of the lower body 214 may unify the top jaw and bottom jaw.

In one embodiment, the first subset of teeth 106*a* may be arranged in a linear, equidistant manner on a single pleat, a platform, or an edge of the material or article 212*a* and the second subset of teeth 106*b* may be secured to a corresponding second pleat, a platform, or an edge of the material or article 212*b*. The second subset of teeth 106*b* may be linearly equidistant between subsequent teeth and oriented so that the first subset of teeth 106*a* and the second subset of teeth 106*b* may engage in an alternating arrangement. In one embodiment, the first subset of teeth 106*a* may overlay the second subset of teeth 106*b*.

In one embodiment, when the material or the article 100 (as in FIG. 1A) includes an opening, the first subset of teeth 106*a* may be located along a first plane that is at the top of the opening and the second subset of teeth 106*b* may be located along a second plane that runs parallel to the first plane and located below the first plane relative to the opening. In one example, the first subset of teeth 106*a* is located above the second subset of teeth such that a bottom portion of the first subset of teeth 106*a* may be interlocked with a top portion of the second subset of teeth 106*b*. The first subset of teeth 106*a* may vertically interlock with the second subset of teeth 106*b*. In another embodiment, a tooth of the first subset of teeth may protrude downwardly relative to the edge of the material so that when the single-finger zipper 102 is in a closed position, the tooth may be adjacent and complementing to a corresponding tooth of the second subset of teeth 106*b* that extends upwardly relative to the edge of the material it is attached to.

Figure 2B:
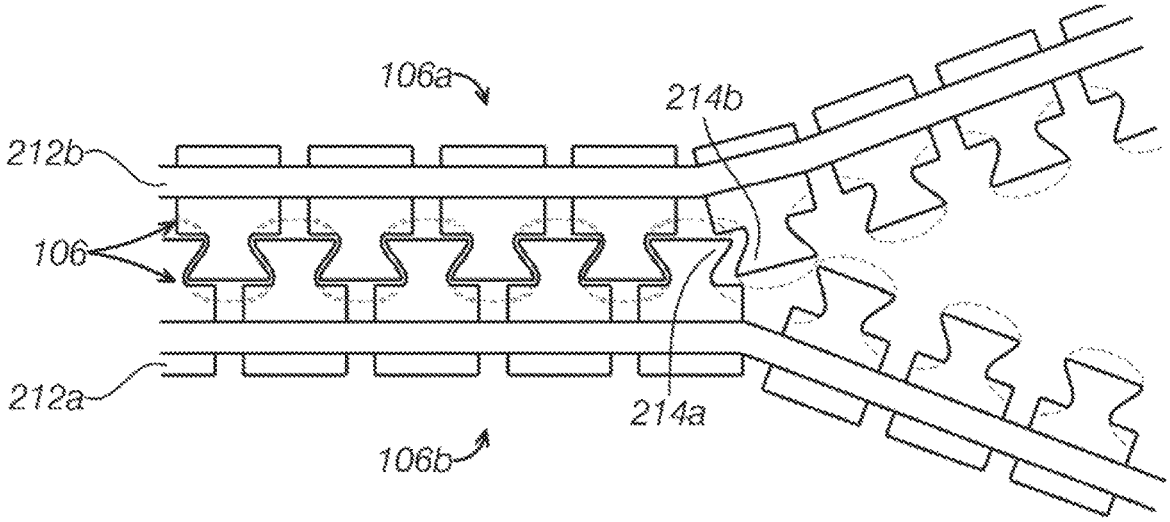
FIG. 2B illustrates interconnecting the first subset of teeth with the second subset of teeth, according to an embodiment.

FIG. 2B illustrates interconnecting the first subset of teeth 106*a* with the second subset of teeth 106*b*, according to an embodiment. As discussed above, the first subset of teeth 106*a* may vertically interconnect with the second subset of teeth 106*b*. In one embodiment, when the first subset of teeth 106*a* is connected to the top portion of the article 212*a* and the second subset of teeth 106*b* is connected to the bottom portion of the article 212*b*, the first subset of teeth 106*a* and the second subset of teeth 106*b* may be aligned such that the bottom of the teeth 106 of the first subset of teeth 106*a* extend toward the top of the teeth 106 of the second subset of teeth 106*b*. In another embodiment, to interconnect a tooth 106 of the first subset of teeth 106*a* with a tooth 106 of the second subset of teeth 106*b*, the teeth may be rotated at an angle relative to each other such that a first edge 214*a* of the tooth 106 of the first subset of teeth 106*a* may be angled inwardly to be inserted beneath a second edge 214*b* of the tooth 106 of tire second subset of teeth 106*b*, or vice versa. The teeth 106 of the first subset of teeth 106*a* and the second subset of teeth 106*b* may be interconnected with each other one by one to fasten the top portion of the article 212*a* to the bottom portion of the article 212*b*. To disconnect the teeth 106 of the first subset of teeth 106*a* and the second subset of teeth 106*b*, the teeth 106 may be rotated at an opposite angle relative to each other.

Figure 2C:
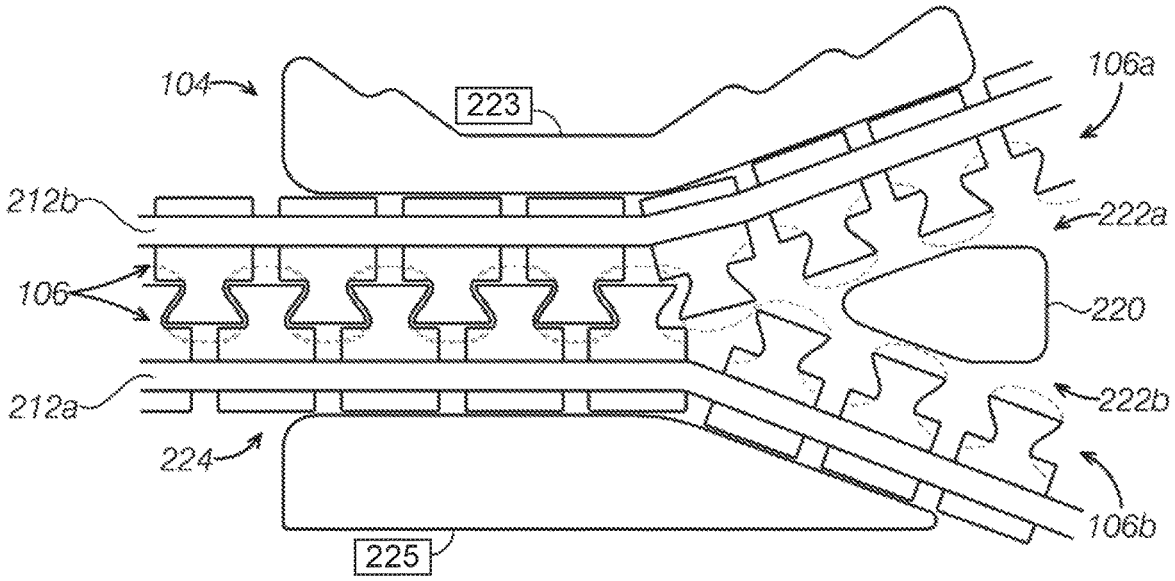
FIG. 2C illustrates the slider interconnecting the first subset of teeth with the second subset of teeth, according to an embodiment.

FIG. 2C illustrates the slider 104 interconnecting the first subset of teeth 106*a* with the second subset of teeth 106*b*, according to an embodiment. Some of the features in FIG. 2B are the same or similar to some of the features in FIGS. 1A-2A as noted by same reference numbers, unless expressly described otherwise. The slider 104 may be configured to rotate the teeth 106 of the first subset of teeth 106*a* and the second subset of teeth 106*b*, as discussed above, to interconnect the teeth 106. In one example, the slider 104 may include a top platform 223, a bottom platform 225, and a divider 220. The divider 220 may be located at a front of the slider 104 to divide a front of the slider 104 to include a top opening 222*a* between the divider 220 and the top platform 223 and a bottom opening 222*b* between the divider 220 and the bottom platform 225.

In one example, to interconnect the teeth 106 of the first subset of teeth 106*a* and the second subset of teeth 106*b*, the slider 104 may be slid forward such that the first subset of teeth 106*a* may be inserted through the top opening 222*a* and the second subset of the teeth 106*b* may be inserted through the bottom opening 222*b*. As the teeth 106 of the first subset of teeth 106*a* and the second subset of teeth 106*b* are inserted through the top opening 222*a* and the bottom opening 222*b*, respectively, the top opening 222*a* and the bottom opening 222*b* may be directed toward each other at a middle portion or slider cavity of the slider 104 at an angle to vertically interconnect the teeth 106, as discussed above. When the teeth 106 are interconnected together, the teeth 106 may then exit out a back opening 224 of the slider 104. To disconnect the teeth 106 from each other, the slides may be slid backward so that the first subset of teeth 106*a* and the second subset of teeth 106*b* move from the back opening 224 to the top opening 222*a* and the bottom opening 222*b*, respectively, and are disconnected by the divider 220 angling the teeth 106 at the reverse angle.

Figure 3A:
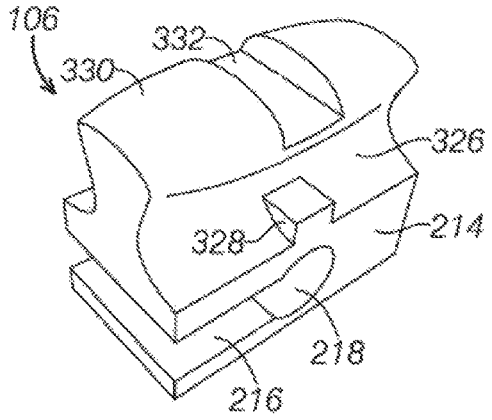
FIG. 3A illustrates a side perspective view of the tooth, according to an embodiment.

FIG. 3A illustrates a side perspective view of the tooth 106, according to an embodiment. Some of the features in FIG. 3A are the same or similar to some of the features in FIGS. 1A-2C as noted by same reference numbers, unless expressly described otherwise. The tooth 106 may include the lower body 214, a neck portion 326, and an upper body 330. The lower body 214 may include the channel 216 extending partially into the lower body 214 along a first plane and the cavity 218 at an end of the channel 216. The neck 326 (also referred to as a grip aperture) may extend upwardly from the lower body 214 toward the upper body 330 to interconnect the lower body 214 with the upper body 330. In one example, the neck 326 may concavely curve inwardly on each side of the neck 326 to form an hourglass shape. The upper body 330 have a semi-cylindrical body extending along a second plane that is parallel and perpendicular to the first plane. In one embodiment, the neck 326 may provide a wider diameter or dimension than the diameter or dimension of the channel 216 to provide relief to the article 100 and retention of the article 100.

In one example, the upper body 330 may include a notch 332 (also referred to as a grip slot) extending downwardly into a top surface of the upper body 330, such as at a horizontal center of the upper body 330. In another example, the neck 326 may include a protrusion 328 extending from a first side and/or a second side of the neck 326. The notch 332 may correspond to the protrusion 328, such as both the notch 332 and the protrusion 328 be located along a center portion of the tooth 106. When a tooth 106 of a first subset of teeth 106*a* is interconnected with a tooth 106 of a second subset of teeth 106*b*, the protrusion 328 may be inserted into the notch 332. In another example, the notch 332 may be located on the top surface near the longitudinal center of the tooth 106 and horizontally coincident with the protrusion 328. The notch 332 may span the lateral distance of the individual tooth and may form a rectilinear depression therein that runs between the major dimensions of an ovular body of the tooth 106.

In one embodiment, one or more of the teeth of the first subset of teeth 106*a* and/or the second subset of teeth 106*b* may be the same size as the teeth of a conventional zipper. In another embodiment, one or more of the teeth of the first subset of teeth 106*a* and/or the second subset of teeth 106*b* may be wider than the teeth of the conventional zipper tooth to accentuate the notch 332 and protrusion 328 to arrest translational motion of the tooth 106 when the single-finger zipper 102 is in a closed position.

The notch 332 of a first tooth 106 may engage with protrusion(s) 328 of second tooth 106 to arrest any translation motion when the single-finger zipper 102 is in the closed position, preventing the closure from being pulled open. The necks 326 of the first and second teeth 106 may be in a mirrored arrangement to allow the alternating teeth 106 of the second subset of teeth 106*b* of teeth to engage with the first subset of teeth 106*a*. The protrusion 328 of a tooth 106 may extend from a top surface of a tooth 106 on an interior bottom of the neck 326 that engages with the notch when the single-finger zipper 102 is in a closed position to arrest translational movement. In one embodiment, each neck 326 of a tooth 106 may include a protrusion 328 to provide a translational retaining mechanism between clustered teeth 106 in an alternating arrangement.

In another embodiment, the single-finger zipper 102 may be configured to eliminate shearing forces exerted on the edges of the halves of the material and the interlocking subsets of teeth 106 and 106*b* of the single-finger zipper 102. For example, by elongating the longitudinal dimension of the subsets of teeth 106*a* and 106*b* to accommodate for the notch 332 and/or a protrusion 328, the teeth 106 may be prevented from moving translationally. Elongating the longitudinal dimension of the subsets of teeth 106*a* and 106*b* with the notch 332 and/or the protrusion 328 may securely retain the subsets of teeth 106*a* and 106*b* as they interlock together at 90-degree angles or approximately 90-degree angles relative to the edges of the halves of the article 100. The approximate 90-degree angle may range from a 45-degree angle to a 135-degree angle.

Figure 3B:
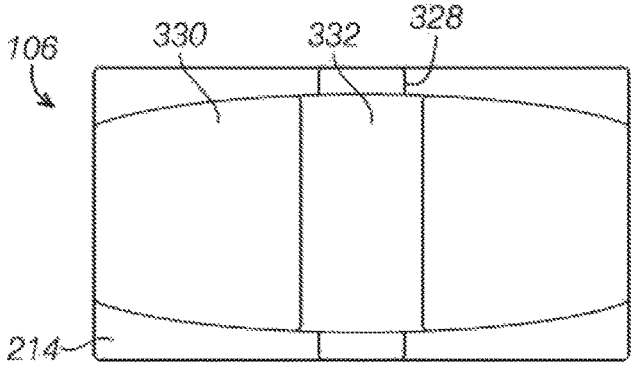
FIG. 3B illustrates a top view of the tooth, according to an embodiment.

FIG. 3B illustrates a top view of the tooth 106, according to an embodiment. Some of the features in FIG. 3B are the same or similar to some of the features in FIGS. 1A-3A as noted by same reference numbers, unless expressly described otherwise. As discussed above and illustrated in FIG. 3B, the upper body 330 of the tooth 106 may include a notch 332 extending into a top surface of the upper body 330 and the neck 326 may include the protrusion 328 extending from a side of the neck 326.

Figure 3C:
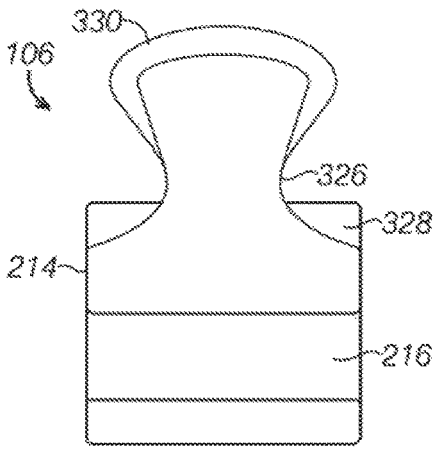
FIG. 3C illustrates a front view of the tooth, according to an embodiment.

FIG. 3C illustrates a front view of the tooth 106, according to an embodiment. Some of the features in FIG. 3C are the same or similar to some of the features in FIGS. 1A-3B as noted by same reference numbers, unless expressly described otherwise. As discussed above and illustrated in FIG. 3C, the neck 326 may extend inwardly to form an hourglass shape.

Figure 3D:
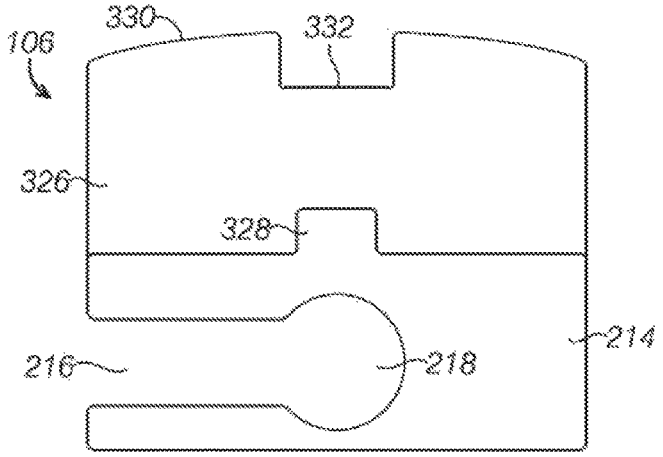
FIG. 3D illustrates a front view of the tooth, according to an embodiment.

FIG. 3D illustrates a front view of the tooth 106, according to an embodiment. Some of the features in FIG. 3D are the same or similar to some of the features in FIGS. 1A-3C as noted by same reference numbers, unless expressly described otherwise. As discussed above and illustrated in FIG. 3D, the tooth 106 may include a lower body 214 with a channel 216 extending along a horizontal plane partially into the lower body 214 and a cavity 218 at an end of the channel 216.

FIG. 4A illustrates a top rear perspective view of the slider 104 of the zipper 102 in FIG. 1A, according to an embodiment. Some of the features in FIG. 4A are the same or similar to some of the features in FIGS. 1A-3D as noted by same reference numbers, unless expressly described otherwise. The slider may include a pleat aperture and one or more ridges along a top surface of the slider.

As discussed above, the slider 104 may slide along the teeth 106 of the zipper 102 to merge and/or divide the first subset of teeth 106*a* and the second subset of teeth 106*b* in FIG. 2A in an ergonomic capacity between the top and the bottom of the zipper 102. In one embodiment, the exterior of the slider 104 may be a fan-shaped body with a lateral dimension larger than the longitudinal dimension of a tooth 106. For example, the topmost surfaces of the exterior of the slider 104 may form an obtuse angle where the bend in the angle is formed at or near the longitudinal center of the slider 104. The slider 104 may include multiple parts that may be connected together via snap fits, tolerance fits, self-orienting geometry, and so forth.

In one example, the slider 104 may include a base portion 434 located at a vertical bottom of the slider 104 and a middle portion 440 located a vertical middle of the slider 104. The slider 104 may also include a first pleat aperture 436 at a first side of the slider 104 between the middle portion 440 and a top portion 441 of the slider and a second pleat aperture 437 at a second side of the slider 104 between the base portion 434 and the middle portion 440. The first pleat aperture 436 may be a space or a slit to allow a first or portion of the article 212*a* (in FIG. 2A) to be slid through the slider 104 when in connection to the first subset of teeth 106*a*. The first pleat aperture 436 may span a longitudinal length of the slider 104. The second pleat aperture 437 may be a space or a slit to allow a second or portion of the article 212*b* (in FIG. 2A) to be slid through the slider 104 when in connection to the second subset of teeth 106*b*. The second pleat aperture 437 may span a longitudinal length of the slider 104.

In one embodiment, the first pleat aperture 436 and/or the second pleat aperture 437 may follow a curvature of an obtuse-angled surface of the exterior of the slider 104 to bend and spread the first subset of teeth 106*a* and the second subset of teeth 106*b*, respectively, allowing the first subset of teeth 106*a* and the second subset of teeth 106*b* to disengage from one another when opening and interlock to one another when closing the zipper 102. In another embodiment, a curvature of the first pleat aperture 436 may be a mirrored congruency with a curvature of the second pleat aperture 437. In one example, the slider 104 may include a rear opening 438 to provide an opening for the interlocked first and second subsets of teeth 106*a* and 106*b* to exit once the first and second subsets of teeth 106*a* and 106*b* are interconnected. In another example, the rear opening 438 may provide an opening for the interlocked first and second subsets of teeth 106*a* and 106*b* to enter the slider 104 that have already been interconnected to disengage or disconnect the first and second subsets of teeth 106*a* and 106*b*.

The slider 104 may include a top portion or platform 441. An exterior surface of the top platform may include finger holder with a flat portion 442, a first angled portion 444, and a second angled portion 446. In one example, the flat portion 442 may be located at a middle section of the top portion 441 along a horizontal plane and between the first angled portion 444 and the second angled portion 446. The first angled portion 444 may extend forward and/upward at a first angle relative to the horizontal plane of the flat portion 442. In one embodiment, the first angle may be between 1 degree and 89 degrees. In another embodiment, the first angle may be between 30 degrees and 60 degrees. The second angled portion 446 may extend rearward and upward at a second angle relative to the horizontal plane of the flat portion 442. In one embodiment, the second angle may be between 1 degree and 89 degrees. In another embodiment, the second angle may be between 30 degrees and 60 degrees. In another embodiment, the first angle may be the same as the second angle.

In another embodiment, the flat portion 442, the first angled portion 444, and the second angled portion 446 may form a concave structure configured to receive a finger of a user. For example, the concave structure may have a U-shape that approximately fix a convex curvature of a tip of a finger of the user. In another embodiment, the first angled portion 444 and/or the second angled portion 446 may be flanges located on the topmost, obtuse-angled surface of the slider 104. The flanges may extend outward in the horizontal direction to provide protection to the underside surface of the material. In another embodiment, the concave structure may provide a first degree of retention when pressed by the finger of the user to allow translation along the teeth 106 of the zipper 102 in FIGS. 1A-2C.

In one embodiment, the first angled portion 444 and/or the second angled portion 446 may have smooth surfaces. In another embodiment, the first angled portion 444 and/or the second angled portion 446 may have ridged surfaces or raised surfaces. In another embodiment the top surface of the slider 104 and/or the ridges may include a friction coating that provides a defined amount of friction that retains the slider 104 to the pressed finger of the user as the user operates the slider 104 to connect and/or disconnect the teeth 106. The friction coating may increase a grippability of the slider 104 by the user. For example, the friction coating may increase the grippability of the slider 104 for the user to operate the slider 104 with a single finger.

In another embodiment the interior of the slider 104 may include a hollow cavity that is shelled out from the exterior. The walls of the slider 104 may have a uniform in thickness throughout. The interior of the slider 104 may interlock and unlock the first subset of teeth 106*a* and the second subset of teeth 106*b* in the open space therein. For example, the hollow cavity may be an open hollow space at an interior of the slider 104 where the first subset of teeth 106*a* and the second subset of teeth 106*b* may engage or disengage when the slider 104 is moved linearly along the first subset of teeth 106*a* and the second subset of teeth 106*b* as the zipper 102 is opened or closed. The rear opening 438 of the slider 104 may be located at the rear of the slider 104 and provide an opening to the hollow cavity. The rear opening 438 may allow the interlocking first subset of teeth 106*a* and the second subset of teeth 106*b* to enter and exit the slider 104 as the zipper 102 is opened or closed, respectively.

FIG. 4B illustrates a bottom rear perspective view of the slider 104 of the zipper 102 in FIG. 1A, according to an embodiment. FIG. 4C illustrates a rear view of the slider 104 of the zipper 102 in FIG. 1A, according to an embodiment. Some of the features in FIGS. 4B and 4C are the same or similar to some of the features in FIGS. 1A-4A as noted by same reference numbers, unless expressly described otherwise.

FIG. 4D illustrates a top front perspective view of the slider 104 of the zipper 102 in FIG. 1A, according to an embodiment. Some of the features in FIG. 4D are the same or similar to some of the features in FIGS. 1A-4C as noted by same reference numbers, unless expressly described otherwise. In one example, the slider 104 may include a teeth divider 450, a top tooth receptacle 452 and a bottom tooth receptacle 454. The teeth divider 450 may be located at the front of the slider 104 in the vertical center of the slider 104 and interstitially located between the top tooth receptacle 452 and the bottom tooth receptacle 454.

The teeth divider 450 may guide the first subset of teeth 106*a* and the second subset of teeth 106*b* of FIG. 2A through the slider 104 to either interlock or unlock the first subset of teeth 106*a* and the second subset of teeth 106*b*. In another example, the first pleat aperture 436 may span between the top tooth receptacle 452 and the rear opening 438 of the slider 104 to permit a first edge of the article 100 to transition through the slider 104. In one example, the top tooth receptacle 452 may be located at the front of the slider 104 near the top thereof and above the teeth divider 450. In another example, the top tooth receptacle 452 may have a rectilinear profile to receive the first subset of teeth 106*a* and an edge of the article. In another example, the second pleat aperture 437 may span between the bottom tooth receptacle 454 and the rear opening 438 of the slider 104 to permit a second edge of the article 100 to transition through the slider 104. In one example, the bottom tooth receptacle 454 may be located at the front of the slider 104 near the bottom thereof and below the teeth divider 450. In another example, the bottom tooth receptacle 454 may have a rectilinear profile to receive the second subset of teeth 106*b* and an edge of the article.

FIG. 4E illustrates a bottom rear perspective view of the slider 104 of the zipper 102 in FIG. 1A, according to an embodiment FIG. 4F illustrates a rear view of the slider 104 of the zipper 102 in FIG. 1A, according to an embodiment FIG. 4G illustrates a side cross-sectional view of the slider 104 of the zipper 102 in FIG. 1A, according to an embodiment. FIG. 4H illustrates a top view of the slider 104 of the zipper 102 in FIG. 1A, according to an embodiment FIG. 41 illustrates a bottom view of the slider 104 of the zipper 102 in FIG. 1A, according to an embodiment. Some of the features in FIGS. 4E-4I are the same or similar to some of the features in FIGS. 1A-4D as noted by same reference numbers, unless expressly described otherwise.

The disclosure above encompasses multiple distinct embodiments with independent utility. While these embodiments have been disclosed in a particular form, the specific embodiments disclosed and illustrated above are not to be considered in a limiting sense as numerous variations are possible. The subject matter of the embodiments includes the novel and non-obvious combinations and sub-combinations of the various elements, features, functions and/or properties disclosed above and inherent to those skilled in the art pertaining to such embodiments. Where the disclosure or subsequently filed claims recite "a" element, "a first" element, or any such equivalent term, the disclosure or claims is to be understood to incorporate one or more such elements, neither requiring nor excluding two or more such elements.

Applicant(s) reserves the right to submit claims directed to combinations and sub-combinations of the disclosed embodiments that are believed to be novel and non-obvious. Embodiments embodied in other combinations and sub-combinations of features, functions, elements and/or properties may be claimed through amendment of those claims or presentation of new claims in the present application or in a related application. Such amended or new claims, whether they are directed to the same embodiment or a different embodiment and whether they are different, broader, narrower or equal in scope to the original claims, are to be considered within the subject matter of the embodiments described herein.

The invention claimed is:

1. A fastening system, including:

a first zipper tooth, including:

a first lower body oriented downward along the z-axis at a 90 degree angle perpendicular to the horizontal surface of the material along the x-axis that includes a first channel extending partially into the first lower body, the first channel being configured to attach to a first portion of a first material; and a first upper body extending upwardly along the z-axis relative to the first lower body, the first upper body having a first semi-cylindrical body oriented along the z-axis at a 90 degree angle perpendicular to the horizontal surface of the material along the x-axis;

a second zipper tooth; including:

a second lower body oriented upward along the z-axis at a 90 degree angle perpendicular to the horizontal surface of the material along the x-axis that includes a second cavity extending partially into the second lower body, the second cavity being configured to attach to a second portion of a second material; and a second upper body extending upwardly along the z-axis from the second lower body, the second upper body having a second semi-cylindrical body oriented along the z-axis at a 90 degree angle perpendicular to the horizontal surface of the material along the x-axis; and a slider configured to vertically interconnect the first zipper tooth with the second zipper tooth along the z-axis at a 90 degree angle perpendicular to the horizontal surface of the material along the x-axis, the slider including:

a bottom zipper receptacle including a second channel at a bottom portion of the slider and extending from a back of the slider to a front of the slider, wherein the second channel is configured to receive the first zipper tooth oriented along the z-axis at a 90 degree angle perpendicular to the horizontal surface of the material along the x-axis;

a top zipper receptacle including a third channel at a top portion of the slider and extending from back of the slider to the front of the slider, wherein the third channel is configured to receive the second zipper tooth oriented along the z-axis at a 90 degree angle perpendicular to the horizontal surface of the material along the x-axis; and a finger holder extending along a top surface of the slider along the horizontal xy-plane, the finger holder having a concave shape that is configured to receive a finger of a user, wherein the slider is operable to vertically interconnect and disconnect the first zipper tooth and the second zipper tooth along the z-axis at a 90 degree angle perpendicular to the horizontal surface of the material along the x-axis when the finger pushes the slider forward or backward along the y-axis.

2. The fastening system of claim 1, wherein the slider further comprises a divider between the bottom zipper receptacle and the top zipper receptacle, wherein the divider is configured to:

rotate the first zipper tooth as the first zipper tooth passes through the bottom zipper receptacle; and rotate the second zipper tooth as the second zipper tooth passes through the top zipper receptacle, wherein the first zipper tooth and the second zipper tooth are rotated to vertically interlock the first zipper tooth and the second zipper tooth along the z-axis at a 90 degree angle perpendicular to the horizontal surface of the material along the x-axis.

3. The fastening system of claim 2, wherein the bottom zipper receptacle is configured to rotate the first zipper tooth at an angle relative to the second zipper tooth such that an edge of the first zipper tooth is angled inwardly to be inserted beneath an edge of the second zipper tooth along the z-axis at a 90 degree angle perpendicular to the horizontal surface of the material along the x-axis.

4. The fastening system of claim 1, wherein the top surface of the slider is perpendicular to the z-axis; and the top surface of the slider is concavely curved to receive a tip of the finger of the user to operate the slider forward or backward along the y-axis.

5. The fastening system of claim 4, wherein at least a portion of the top surface of the slider includes a ridge to provide a grip for the finger of the user to operate the slider forward or backward along the y-axis parallel to the material.

6. The fastening system of claim 1, further including a first pleat aperture at a first side of the slider between a middle portion of the slider and the top portion of the slider, wherein the first pleat aperture is configured to provide a first slit to allow a first portion of an article connected to the first zipper tooth to be slid through the slider, wherein the first zipper tooth is orientated downward along the z-axis at a 90 degree angle perpendicular to the horizontal surface of the material along the x-axis.

7. The fastening system of claim 6, further including a second pleat aperture at a second side of the slider between the middle portion of the slider and the bottom portion of the slider, wherein the second pleat aperture is configured to provide a second slit to allow a second portion of an article connected to the second zipper tooth to be slid through the slider, wherein the second zipper tooth is orientated upward along the z-axis at a 90 degree angle perpendicular to the horizontal surface of the material along the x-axis.

8. The fastening system of claim 7, wherein the first zipper tooth and the second zipper tooth are oriented vertically at 90 degree angles relative to edges of halves of the material such that the first zipper tooth and the second zipper tooth vertically interconnect along the z-axis at a 90 degree angle perpendicular to the horizontal surface of the material along the x-axis.

9. The fastening system of claim 1, wherein the first zipper tooth includes a neck to connect the first lower body to the first upper body along the z-axis at a 90 degree angle relative to the surface of the material along the x-axis.

10. The fastening system of claim 9, wherein the neck curves inwardly such that the neck and the first upper body form an hourglass shape oriented along the z-axis at a 90 degree angle relative to the surface of the material along the x-axis.

11. The fastening system of claim 1, wherein the first zipper tooth includes a fourth channel extending partially into the first lower body and a cavity at an end of the first lower body oriented along the z-axis at a 90 degree angle relative to the surface of the material along the x-axis.

12. The fastening system of claim 11, wherein the fourth channel and the cavity are configured to receive a portion of an article.

13. The fastening system of claim 1, where the first zipper tooth includes a notch along the top surface of the first upper body and a protrusion extending from a neck connecting the first lower body to the first upper body oriented along the z-axis at a 90 degree angle relative to the surface of the material along the x-axis.

14. A fastening apparatus, including:

a first zipper tooth, including:

a first lower body oriented along the z-axis at a 90 degree angle perpendicular to the horizontal surface of the material along the x-axis that includes a first channel extending partially into the first lower body, the first channel being configured to attach to a first portion of a first material; and a first upper body extending upwardly along the z-axis from file first lower body, the first upper body having a first semi-cylindrical body oriented along the z-axis at a 90 degree angle perpendicular to the horizontal surface of the material along the x-axis; and a second zipper tooth, including:

a second lower body oriented along the z-axis at a 90 degree angle perpendicular to the horizontal surface of the material along the x-axis that includes a second cavity extending partially into the second lower body, the second cavity being configured to attach to a second portion of a second material; and a second upper body extending upwardly along the z-axis from the second lower body, the second upper body having a second semi-cylindrical body oriented along the z-axis at a 90 degree angle perpendicular to the horizontal surface of the material along the x-axis.

15. The fastening apparatus of claim 14, further including a slider configured to vertically interconnect the first zipper tooth with the second zipper tooth along the z-axis perpendicular to the horizontal surface of the material along the x-axis, the slider including:

a bottom zipper receptacle including a second channel at a bottom portion of the slider and extending from a back of the slider to a front of the slider, wherein the second channel is configured to receive the first zipper tooth oriented along the z-axis at a 90 degree angle perpendicular to the horizontal surface of the material along the x-axis; and a top zipper receptacle including a third channel at a top portion of the slider and extending from the back of the slider to the front of the slider, wherein the third channel is configured to receive the second zipper tooth oriented along the z-axis at a 90 degree angle relative to the surface of the material.

16. The fastening apparatus of claim 15, further including a finger holder extending along a top surface of the slider along the xy-plane perpendicular to the z-axis, the finger holder having a concave shape that is configured to receive a finger of a user, wherein the slider is operable to vertically interconnect and disconnect the first zipper tooth and the second zipper tooth along the z-axis at a 90 degree angle to the horizontal surface of the material along the x-axis when the finger slides the slider forward or backward along the y-axis.

17. The fastening apparatus of claim 15, wherein the slider further comprises a divider between the bottom zipper receptacle and the top zipper receptacle, wherein the divider is configured to:

rotate the first zipper tooth oriented along the z-axis at a 90 degree angle relative to the surface of the material as the first zipper tooth passes through the bottom zipper receptacle along the y-axis; and rotate the second zipper tooth oriented along the z-axis at a 90 degree angle relative to the surface of the material as the second zipper tooth passes through the top zipper receptacle along the y-axis, wherein the first zipper tooth and the second zipper tooth are rotated to vertically interlock the first zipper tooth and the second zipper tooth along the z-axis perpendicular to the horizontal surface of the material along the x-axis.

18. A fastening device, including a slider configured to vertically interconnect a first zipper tooth with a second zipper tooth along the z-axis at a 90 degree angle perpendicular to the horizontal surface of the material along the x-axis, the slider including:

a bottom zipper receptacle including a first channel at a bottom portion of the slider and extending from a back of the slider to a front of the slider, wherein the first channel is configured to receive the first zipper tooth oriented along the z-axis perpendicular to the horizontal surface of the material along the x-axis;

a top zipper receptacle including a second channel at a top portion of the slider and extending from the back of the slider to the front of the slider, wherein the second channel is configured to receive the second zipper tooth oriented along the z-axis perpendicular to the horizontal surface of the material along the x-axis; and a finger holder extending along a top surface of the slider, the finger holder having a concave shape along the xy-plane that is configured to receive a finger of a user, wherein the slider is operable to vertically interconnect and disconnect the first zipper tooth and the second zipper tooth when the finger slides the slider forward or backward along the y-axis.

19. The fastening device of claim 18, further including: a first zipper tooth, including:

a first lower body that includes a third channel extending partially into the first lower body, the third channel being configured to attach to a first portion of a first material; and a first upper body extending upwardly along the z-axis from the first lower body, the first upper body having a first semi-cylindrical body oriented along the z-axis at a 90 degree angle perpendicular to the horizontal surface of the material along the x-axis; and a second zipper tooth, including:

a second lower body that includes a second cavity extending partially into the second lower body, the second cavity being configured to attach to a second portion of a second material; and a second upper body extending upwardly along the z-axis from the second lower body, the second upper body having a second semi-cylindrical body oriented along the z-axis at a 90 degree angle perpendicular to the horizontal surface of the material along the x-axis.

20. The fastening device of claim 19, wherein the slider further comprises a divider between the bottom zipper receptacle and the top zipper receptacle, wherein the divider is configured to:

rotate the first zipper tooth as the first zipper tooth passes through the bottom zipper receptacle; and rotate the second zipper tooth as the second zipper tooth passes through the top zipper receptacle, wherein the first zipper tooth and the second zipper tooth are rotated to vertically interlock the first zipper tooth and the second zipper tooth along the z-axis perpendicular to the horizontal surface of the material along the x-axis.

* * * * *